US007243876B2

(12) United States Patent
Robison

(10) Patent No.: US 7,243,876 B2
(45) Date of Patent: Jul. 17, 2007

(54) METHOD AND APPARATUS FOR HANDLING WIRE SPOOLS

(76) Inventor: Clyde R. Robison, 1512 Spring Bay Rd., East Peoria, IL (US) 61611

( * ) Notice: Subject to any disclaimer, the term of this patent is extended or adjusted under 35 U.S.C. 154(b) by 377 days.

(21) Appl. No.: 10/894,184

(22) Filed: Jul. 19, 2004

(65) Prior Publication Data

US 2006/0011774 A1 Jan. 19, 2006

(51) Int. Cl.
*B65H 49/32* (2006.01)
*B65H 75/42* (2006.01)

(52) U.S. Cl. ..... 242/557; 242/597.5; 242/594

(58) Field of Classification Search ..... 242/597.1, 242/597.4, 597.5, 597.6, 594, 557, 403, 533.8, 242/597.7, 131, 131.1
See application file for complete search history.

(56) References Cited

U.S. PATENT DOCUMENTS

| | | | | |
|---|---|---|---|---|
| 330,960 | A | 11/1885 | Clark | |
| 337,830 | A | 3/1886 | Gilman | |
| 353,928 | A | 12/1886 | Eaton | |
| 2,699,100 | A | 1/1955 | Simjian | |
| 2,705,114 | A | 3/1955 | Worsham | |
| 3,072,357 | A | 1/1963 | Sprague et al. | |
| 3,603,526 | A | 9/1971 | Payne | |
| 3,831,877 | A | 8/1974 | Bennett et al. | |
| 3,856,230 | A | 12/1974 | Zimmer | |
| 3,856,981 | A | 12/1974 | Boundy | |
| 3,937,414 | A | 2/1976 | Bank et al. | |
| 3,990,653 | A | 11/1976 | Marcell | |
| 4,391,422 | A | 7/1983 | McDonald | |
| 4,564,152 | A | 1/1986 | Herriage | |
| 4,705,283 | A | 11/1987 | Kleisath | |
| 4,747,561 | A | 5/1988 | Sweeny et al. | 242/96 |
| 5,100,074 | A | 3/1992 | Jones | |
| 5,222,683 | A | 6/1993 | Blackshire | 242/137 |
| 5,238,201 | A | 8/1993 | Jonushaitis | 242/96 |
| 5,285,981 | A | 2/1994 | Pavelka | |
| 5,316,232 | A | 5/1994 | Lambert, Jr. | |
| 5,348,241 | A | 9/1994 | Huette | 242/597.5 |
| 5,509,671 | A * | 4/1996 | Campbell | 280/47.19 |
| 5,636,809 | A | 6/1997 | Koch | 242/422.5 |
| 5,687,928 | A | 11/1997 | Lassiter | |
| 5,732,899 | A | 3/1998 | Wells | 353/423.1 |
| 6,086,013 | A | 7/2000 | Looney, Jr. et al. | |
| 6,270,094 | B1 | 8/2001 | Campbell | |
| 6,367,725 | B1 | 4/2002 | Goodwin | |
| 6,367,754 | B1 | 4/2002 | Clinker | 248/228.1 |
| 6,422,504 | B1 | 7/2002 | Elder | 353/594.6 |
| 6,523,776 | B1 | 2/2003 | Elder | 242/594.4 |
| 6,612,516 | B1 | 9/2003 | Haines | |
| 6,634,592 | B1 | 10/2003 | Berousek | 242/594.3 |

* cited by examiner

*Primary Examiner*—Patrick Mackey
*Assistant Examiner*—William E Dondero
(74) *Attorney, Agent, or Firm*—Husch & Eppenberger LLC; Robert C. Haldiman

(57) ABSTRACT

An apparatus for handling wire spools is disclosed. The apparatus includes a brace and a spool handle removably connected to the base. A spool is mounted on the handle and thereafter a user picks up the handle and mounts it on the base. Thereafter, wire can be dispensed from the spool.

21 Claims, 3 Drawing Sheets

METHOD AND APPARATUS FOR HANDLING WIRE SPOOLS

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention relates generally to construction tools and, more particularly, it relates to tools to facilitate installation of electrical wiring within buildings and other structures.

2. Related Art

U.S. Pat. No. 6,270,094 issued to Campbell on Aug. 7, 2001 discloses a wire dispensing utility cart. The Campbell cart has a wheel, a base, and several upright members extending from the base. The upright members include mandrels for horizontally mounting wire spools. However, spools laden with heavy wire are cumbersome and difficult to mount on such spool mandrel.

U.S. Pat. No. 6,634,592 issued to Berousek issued on Oct. 21, 2003 discloses a detachable wire and cable despooler. The Berousek device is mounted on lumber, such as a wall stud, and clamped thereon. When the despooler is mounted, a user places one or more spools on the despooler. Again, wire spools laden with heavy wire are cumbersome and difficult to mount on the Berousek device.

There remains a need in the art for a simple but effective despooler that can be used to easily locate the spool with stability. There remains a need for a despoiler that is durable, easy to use, adaptable, mobile, independent, and economical.

SUMMARY OF THE INVENTION

It is in view of the above problems that the present invention was developed. The invention is an apparatus for handling wire spools. The apparatus includes a base and a spool handling device removably connected to the base. A spool is mounted on the spool handling device and thereafter a user can pick up the spool handling device and mount it on the base for despooling of the wire from the spool.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
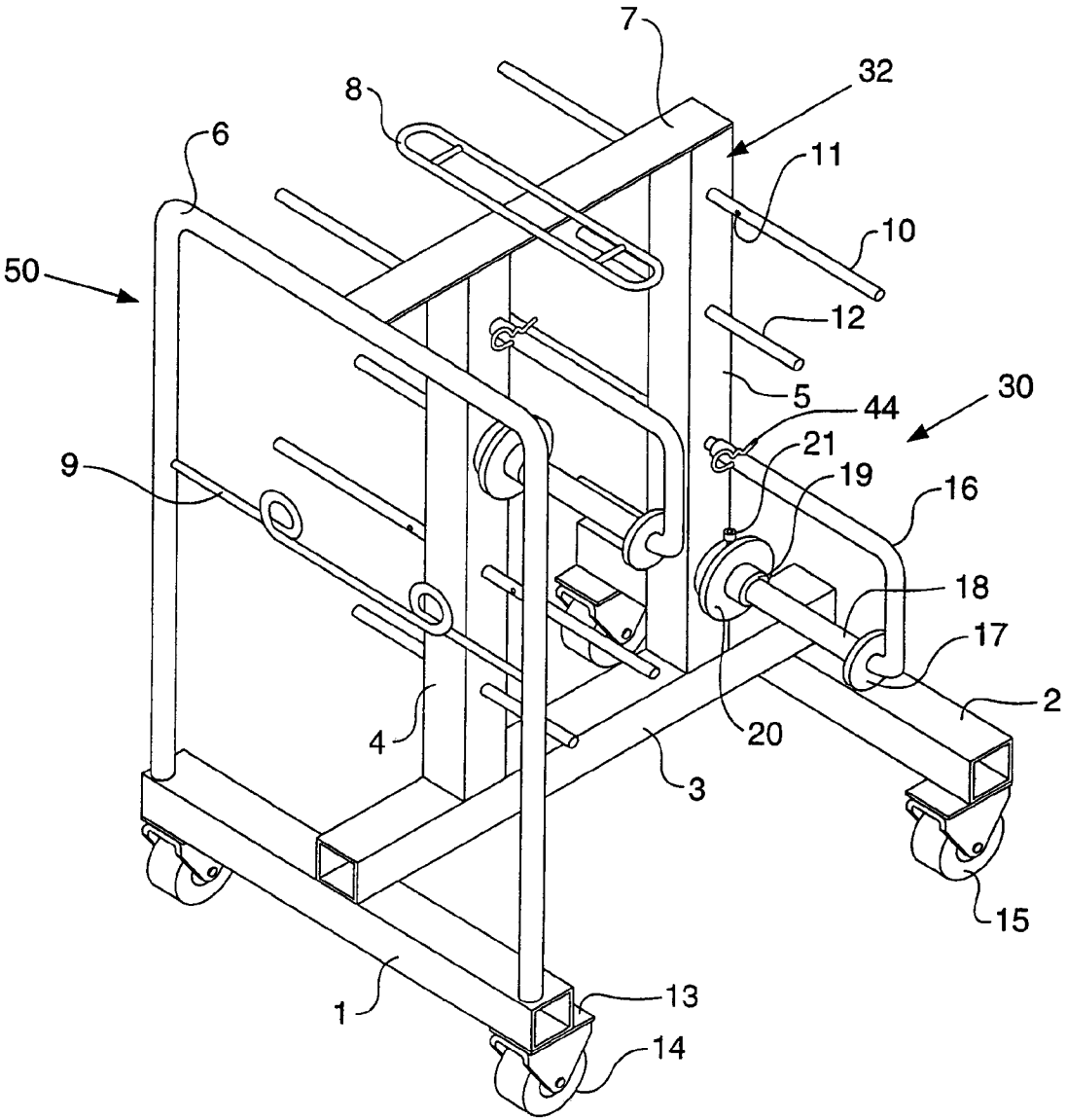
FIG. 1 is a perspective view of an apparatus for handling wire spools in a first embodiment.

Referring to the accompanying drawings in which like reference numbers indicate like elements, FIG. 1 illustrates an apparatus 50 for handling wire spools. The apparatus 50 includes a frame or base 30 and at least one spool lifting handle 16 removably connected to the base 30.

The base 30 includes a rear support member 1 and a front support member 2. The front support member 2 is substantially parallel to the rear support member 1. A center support member 3 interconnects the rear support member 1 and the front support member 2. In the depicted embodiment, the center support 3 is transverse to both the rear support member 1 and the front support member 2. A front upright member 5 and a rear upright member 6 extend vertically from the center support member 3. A center upright member 4 also extends vertically from the center support member 3. In the depicted embodiment, the rear upright member 6 is in the form of a U-shaped push-bar handle.

A plurality of wheel support plates 13 are operatively connected to the front and rear support members 1, 2 on the bottom. Wheels 14, 15 are connected to the wheel support plates 13. In the depicted embodiment, the wheels connected to the rear support member 1 are swivel wheels 14 and the wheels connected to the front support member 2 are non-swivel wheels 15. A top tie member 7 is operatively connected to the front upright member 5 and extends longitudinally parallel to the center support member 3. A first wire guide 8 is operatively connected to the top tie member 7, and a second wire guide 9 is operatively connected to the rear upright member 6. The first and second wire guides 8, 9 guide the wire as it is dispensed from a spool.

A plurality of handle support bars 10 are operatively connected to the front upright member 5 and the center upright member 4. In some embodiments, the plurality of handle support bars 10 are also operatively connected to the rear upright member 6. As an example, the plurality of handle support bars 10 may be cylindrical; however, other shapes may be used. In the depicted embodiment, the plurality of handle support bars 10 extend transversely from a first face 32 of the center and front upright members 4, 5. A plurality of guide bars 12 are operatively connected to the front upright member 5 and the center upright member 4. In some embodiments, the plurality of guide bars 12 are also operatively connected to the rear upright member 6. In the depicted embodiment, the spool lifting handle 16 is removably connected to the base 30 via the handle support bars 10 and/or the guide bars 12. For example, the spool lifting handle 16 may be U-shaped such that it is connected to one of the support bars 10 and one of the guide bars 12. In some embodiments, the handle support bars 10 each include a hole 11. The hole 11 and a pin 44 are used to lock the spool lifting handle 16 in place after mounting.

Figure 2:
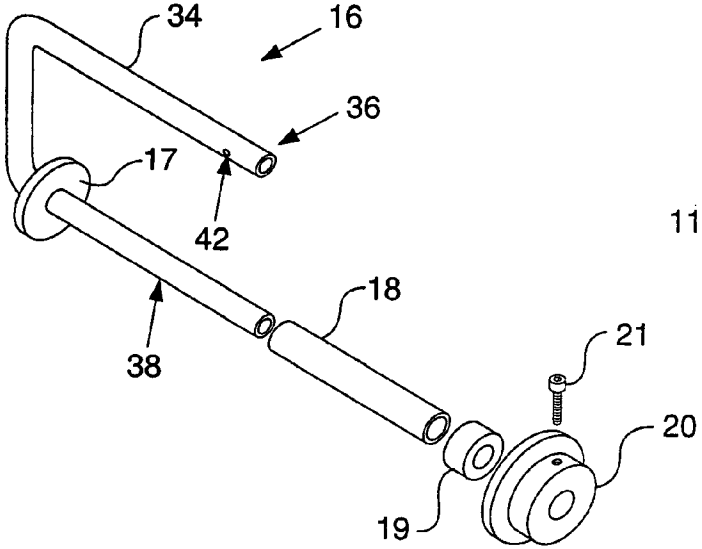
FIG. 2 is a perspective view of a spool handle in a first embodiment.

FIG. 2 illustrates a detailed view of the spool lifting handle 16. The spool lifting handle 16 includes a locating plate 17, a spool bearing 18, a bearing retainer 19, a spool retainer 20, and a handle frame 34. In the depicted embodiment, the handle frame 34 is tubular and is dimensioned to receive one of the handle support bars 10 on one end. In some embodiments, the tubular handle frame is also dimensioned to receive one of the guide bars 12. In some embodiments, the handle frame 34 also include a locking pin hole 42.

The spool lifting handle 16 also includes a grip portion 36 and a spool support portion 38. The spool support portion 38 is offset from the grip portion 36. A user (not shown) grips the grip portion 36 for lifting the spool lifting handle 16, and a spool (not shown) is generally mounted about the spool support portion 38. The spool support portion 38 provides an axis of rotation for the spool. The locating plate 17 locates one end of the spool when mounted on the spool support portion 38. As an example, the locating plate 17 may simply be a flat washer.

The spool bearing 18 allows the spool to rotate. The spool bearing 18 is intermediate the spool and the spool support portion 38. The locating plate 17 also locates one end of the spool bearing 18. The other end of the spool bearing 18 is located by the bearing retainer 19. The spool retainer 20 locates the other end of the spool. A fastener 21 threadingly engages the spooler retainer 20 to fixedly connect it to the spool support portion 38.

Figure 4:
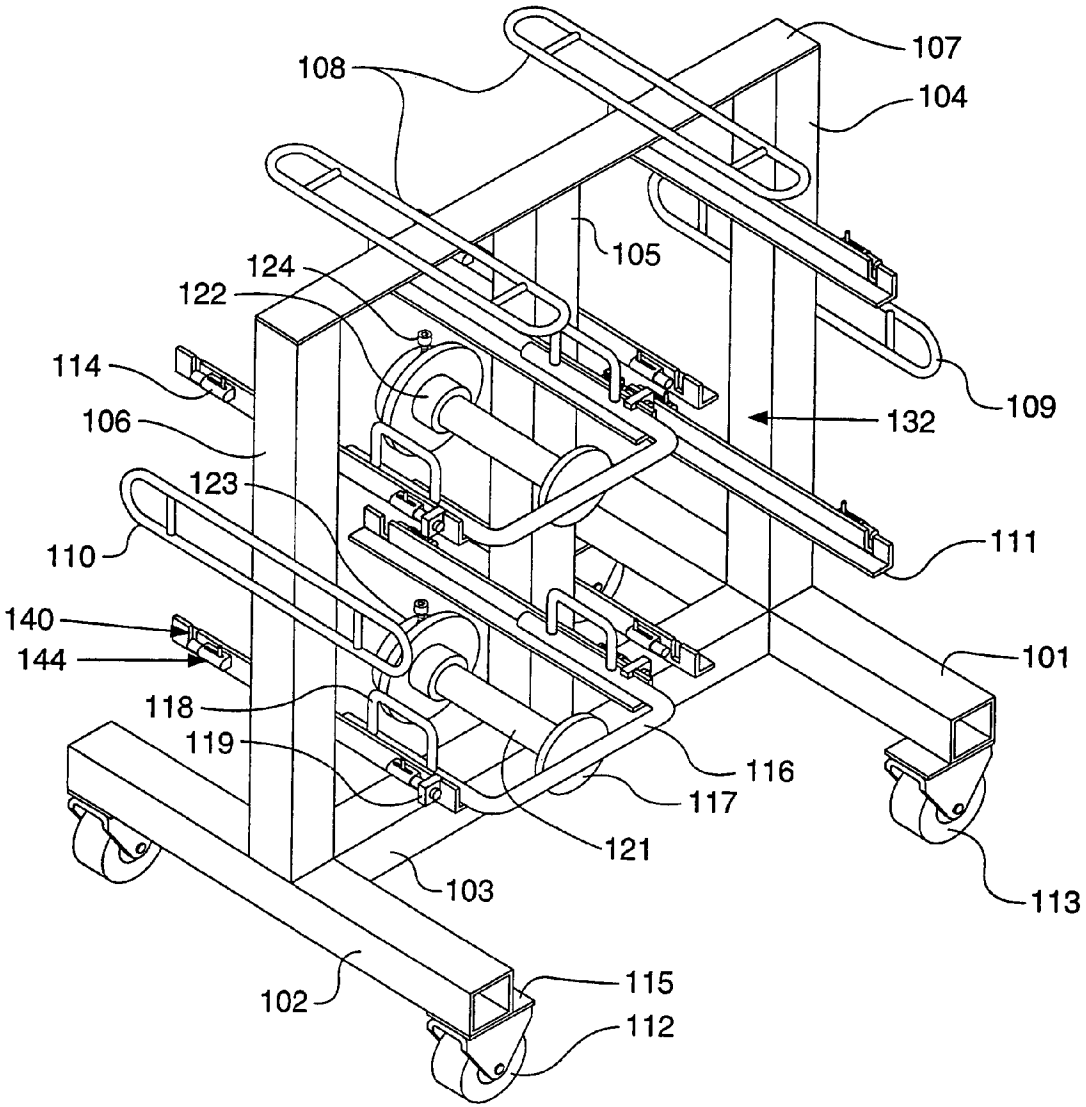
FIG. 4 is a perspective view of the apparatus for handling wire spools in a second embodiment.

FIG. 4 illustrates a second embodiment of the apparatus for handling wire spools 150. The apparatus 150 includes a base 130 and at least one spool lifting handle 116 removably connected to the base 130.

The base 130 includes a rear support member 101 and a front support member 102. The front support member 102 is offset from the rear support member 101. A center support member 103 interconnects the rear support member 101 and the front support member 102. A rear upright member 104, a center upright member 105 and a front upright member 106 all extend transversely from the center support member 103.

A top tie bar 107 interconnects the rear upright member 104 and the front upright member 106. First wire guides 108 are operatively connected to the top tie bar 107. A second wire guide 109 is operatively connected to the rear upright member 104. A third wire guide 110 is operatively connected to the front upright member 106.

The base 130 also includes wheel support plates 115 which are operatively connected to the front support member 102 and rear support member 101. Wheels 112, 113 are operatively connected to the wheel support plates 115. In the depicted embodiment, non-swivel wheels 112 are operatively connected to the front support member 102 and swivel wheels 113 are operatively connected to the rear support member 101.

A plurality of handle support bars 111 are operatively connected to the upright members 104, 105, 106. As an example, some of the handle support bars 111 are mounted on a second face 132 of the rear upright member 104. In the depicted embodiment, the handle support bars 111 are L-shaped; however, other shapes may be used. The plurality of handle support bars 111 are adapted to receive the spool lifting handles 116. For example, the handle support bar 111 may include a notch 140 for receiving a locking pin bracket 119 located on the spool lifting handle 116. In some embodiments, the base 130 includes a locking mechanism 144 operatively connected to the handle support bar 111. The locking mechanism 144 may be used to lock in place the spool lifting handle 116 once it is received by the handle support bar 111.

Figure 3:
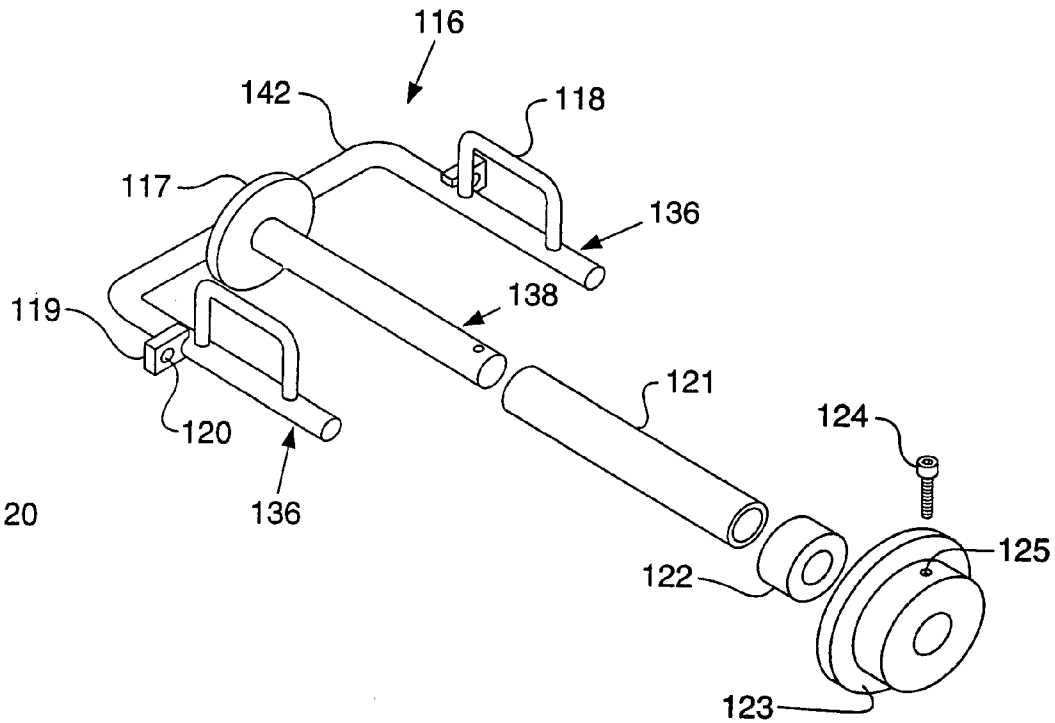
FIG. 3 is a perspective view of the spool handle in a second embodiment.

FIG. 3 illustrates a detailed view of the spool lifting handle 116 of the alternative embodiment. The spool lifting handle 116 includes a locating plate 117, the locking pin brackets 119, a spool bearing 121, a bearing retainer 122, a spool retainer 123, and a handle frame 142. In the depicted embodiment, the handle frame 142 is made from a solid metal bar. However, those skilled in the art will understand that other materials, other shapes, and other geometric configurations may be used. In some embodiments, the locking pin bracket 119 includes a locking pin hole 120 to receive the locking mechanism 144.

The spool lifting handle 116 also includes grip portions 136 and a spool support portion 138. The spool support portion 138 is offset from the grip portions 136. A user (not shown) grips the grip portion 136, and a spool (not shown) is generally mounted about the spool support portion 138. In other words, the spool support portion 138 provides an axis of rotation for the spool. In the depicted embodiment, lifting handles 118 are operatively connected to the grip portions 136 to provide the user with a convenient place to grasp. However, those skilled in the art will understand that one or more workers could also each grab a grip portion 136 to lift the spool lifting handle 116. The locating plate 117 locates one end of the spool when mounted on the spool support portion 138. As an example, the locating plate 117 may simply be a flat washer.

The spool bearing 121 allows the spool to rotate. The spool bearing 121 is intermediate the spool and the spool support portion 138. The locating plate 117 also locates one end of the spool bearing 121. The other end of the spool bearing 121 is located by the bearing retainer 122. The spool retainer 123 locates the other end of the spool. A fastener 124 threadingly engages a threaded hole 125 in the spooler retainer 123 to fixedly connect it to the spool support portion 138.

In operation, a worker slides the bearing 18 and the support 38 into a spool. The worker then places the bearing retainer 19 on the end of the spool support portion 38, and attaches the spool retainer 20. Thereafter, the user picks up the handle 16 using the grip portion 36 and mounts it on the handle support bar 10. In some embodiments, the user also will mount the support bar 38 onto the guide bar 12. In some embodiments, the user secures the handle 16 to the handle support bar 10 by placing the pin 44 into the pin hole 42 and through the hole 11. Once the handle 16 is secured, the user can dispense wire from the spool.

As an optional step, the worker may thread the wire from the spool through an eyelet, such as first and second wire guides 8,9. The wire guides 8,9 assist the worker in despooling the wire in a direction transverse to an axis of the spool. In other words, the eyelets 8,9 allow the worker to pull wire from the spool from almost any direction.

A method of assembling an apparatus for handling wire spools includes the following steps: providing a rear support member; providing a front support member substantially parallel to said rear support member; interconnecting said rear support member to said front support member with a center support member; connecting transversely a center upright member to said center support member; connecting a front upright member to said center support member; connecting a top tie member to said center support member; connecting a rear upright member at one end to said top tie member and at the other end to said rear support member; connecting each of said plurality of handle support bars to said center upright member or to said front upright member; and mounting at least one spool lifting handle to at least one of said plurality of handle support bars. In some embodiments, the method also includes the step of: mounting a wire guide to said front upright member or to said rear upright member.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An apparatus for handling wire spools comprising:

a frame;

at least one set of handle support members, each of said handle support members having a longitudinal axis and being attached to said frame;

at least one spool lift handle, each spool lift handle having a set of spool lift handle extensions, each of said extensions having a longitudinal axis;

a spool support portion, said spool support portion being integral to said spool lift handle;

one of said handle support members or said spool lift handle extensions being a rod and the other of said handle support members or said spool lift handle extensions being a rod receiver having a longitudinally extending hole dimensioned to receive said rod within said hole in sliding engagement along said longitudinal axis;

whereby, when said handle support members and said spool lift handle extensions are engaged, a spool on said spool support portion is supported in a preconfigured position relative to said frame; and said spool lift handle having a handle portion.

2. The apparatus of claim 1 wherein said rod receiver is selected from the group consisting of: a tube and an angle iron.

3. The apparatus of claim 2 wherein at least one of said rod or said rod receiver are cylindrical.

4. The apparatus of claim 1 wherein at least one of said rods is substantially perpendicular to a member of said frame at said attachment of said rod to said frame.

5. The apparatus according to claim 1, wherein said at least one spool lifting handle is U-shaped.

6. The apparatus according to claim 1, wherein said at least one spool lifting handle comprises two grip portions.

7. The apparatus according to claim 6, wherein said two grip portions are substantially opposed.

8. The apparatus according to claim 1, wherein said frame includes at least one upright member and said at least one grip portion is transverse to said at least one upright member.

9. The apparatus according to claim 1, wherein said at least one spool lifting handle further comprises at least one spool bearing intermediate said spool support portion and said spool.

10. The apparatus according to claim 1, wherein said at least one spool lifting handle further comprises at least one of the following: a locating plate, a spool retainer, and a bearing retainer.

11. The apparatus according to claim 1, further comprising a wire guide operatively connected to said frame.

12. The apparatus according to claim 11, wherein said wire guide is deployed to be in line for guiding more than one spool of wire.

13. The apparatus according to claim 1, further comprising at least one wheel operatively connected to said frame.

14. The apparatus according to claim 13, further comprising at least three wheels operatively connected to said frame.

15. The apparatus according to claim 14, wherein a center of gravity of a spool when mounted on said apparatus is substantially between said at least three wheels.

16. The apparatus according to claim 1, further comprising at least one guide bar operatively connected said frame.

17. The apparatus according to claim 1, further comprising a pin, said pin locking said rod and said rod receiver in place when said spool lift handle is mounted on said frame.

18. The apparatus according to claim 1, further comprising spool lift handles for at least four spools.

19. The apparatus according to claim 1, further comprising at least two engagements of said rods and said rod receivers for each spool mounted on said apparatus.

20. The apparatus according to claim 1, further comprising said spool support portion is offset from said handle portion.

21. The apparatus according to claim 1 wherein said frame remains upright during use.

* * * * *